United States Patent [19]

Harris et al.

[11] 4,007,956

[45] Feb. 15, 1977

[54] DOORKNOB GUARD

[76] Inventors: Steven K. Harris, 2142 Via Barrett, San Lorenzo, Calif. 94980; Stanley P. Schiffman, 22 Glen Alpine Road, Piedmont, Calif. 94611

[22] Filed: May 23, 1975

[21] Appl. No.: 580,294

[52] U.S. Cl. ..... 292/347; 292/DIG. 2; 292/357

[51] Int. Cl.[2] ..... E05C 19/18

[58] Field of Search ..... 292/347, 357, DIG. 2; 70/455, 416, DIG. 58

[56] References Cited

UNITED STATES PATENTS

| | | | |
|---|---|---|---|
| 3,306,643 | 2/1967 | Reed | 292/1 |
| 3,428,351 | 2/1969 | Volk | 70/DIG. 58 |

*Primary Examiner*—Richard E. Moore
*Attorney, Agent, or Firm*—Harris Zimmerman

[57] ABSTRACT

A device which protects the knob of a door lock to prevent the breaking thereof and entry includes an outer cylindrical member rotatably secured about the knob assembly by the rose of the knob assembly. An inner cylindrical member is secured about the knob assembly, and includes a plurality of axially extending grooves which engage cooperating ribs extending inwardly from the outer member. The inner member includes a hole in one end thereof to permit key access to the knob, and at least one annular friction ring disposed within the inner member for transmitting a limited magnitude of torque to the knob. The device protects the knob assembly by preventing tampering therewith and also preventing breaking the lock by applying high torque to the knob.

7 Claims, 4 Drawing Figures

FIG_1
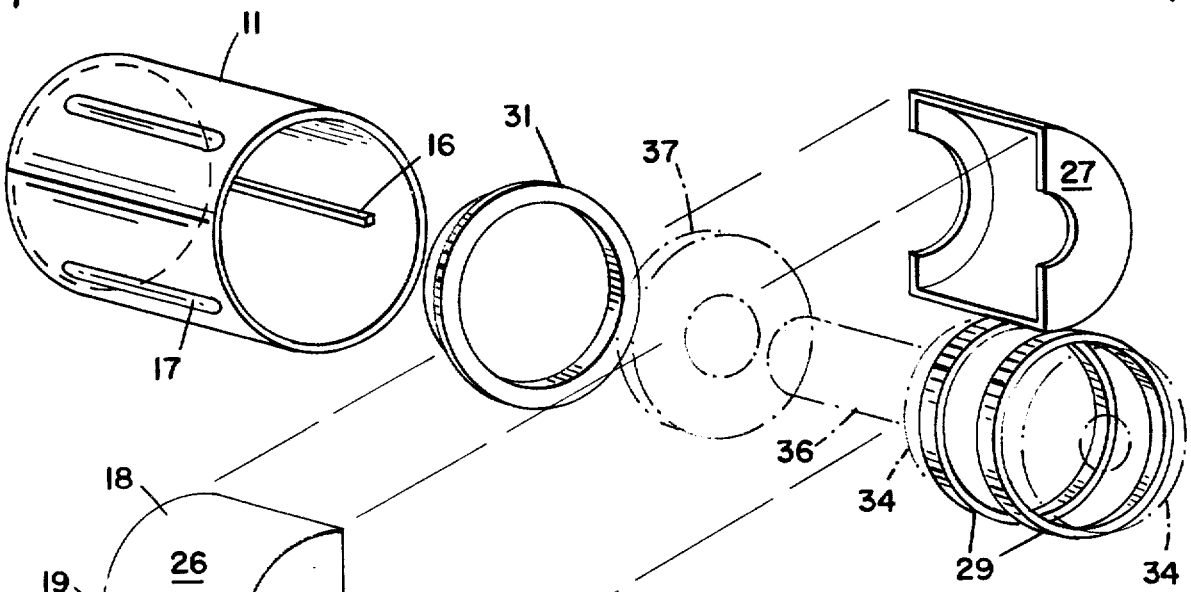
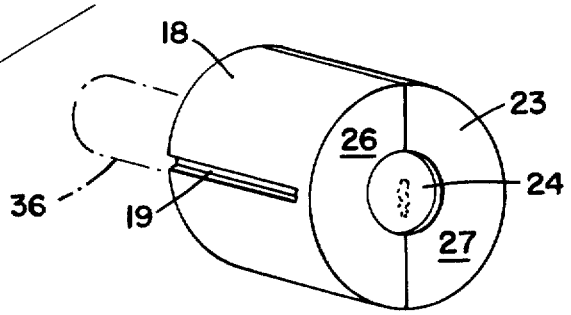
FIG_2
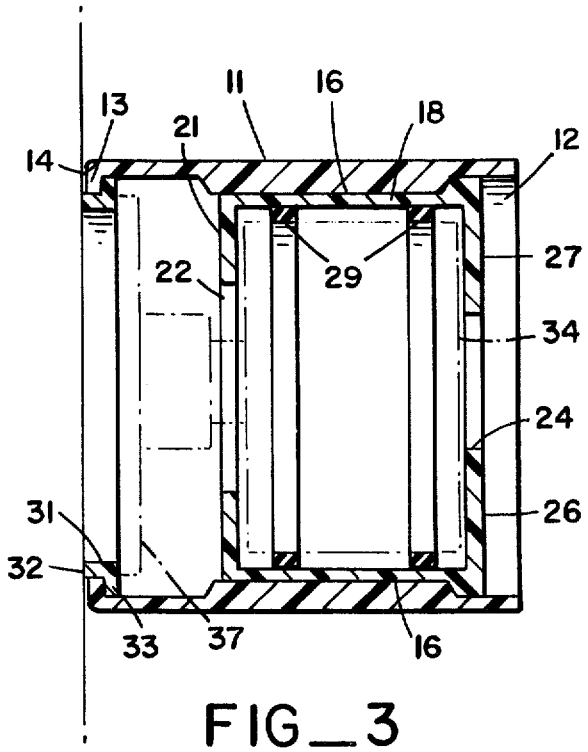
FIG_3
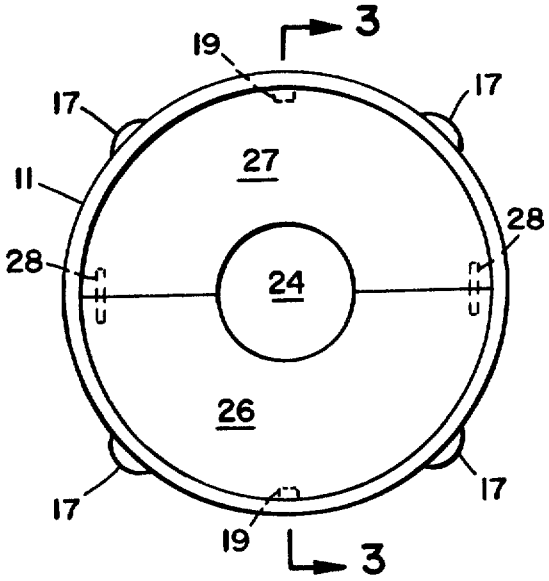
FIG_4

DOORKNOB GUARD

BACKGROUND OF THE INVENTION

In the continuing struggle of property owners to protect their belongings from thieves and burglars, it appears that every protective measure is eventually circumvented by new burgling techniques. A new burgling method, which requires less talent than temerity, involves the use of a pipe wrench or the like to apply a high torque to a door knob, breaking the internal lock mechanism and thereby gaining entry through the door. Generally the burglar carries the pipe wrench concealed in a coat sleeve, and is able surreptitiously to break the lock and gain entry in approximately the same amount of time as an individual using a key, with no untoward indications that a burglary is taking place.

SUMMARY OF THE INVENTION

The present invention generally comprises a device which protects a door knob assembly from being overtorqued and broken, while permitting normal entry with a key. It includes a retaining ring which is secured between the door knob rose and the door, and an outer cylindrical member pivotally secured at one end to the retaining ring and enclosing the door knob assembly. The other end of the outer cylindrical member is open. A plurality of axially disposed ribs extend radially inwardly from the bore of the outer cylinder.

An inner cylindrical member is disposed within the outer cylinder, and includes a plurality of grooves which receive the ribs in axially slidable fashion, transmitting the torque from the outer to inner member. The inner member is bifurcated along an axial plane, the two halves releasably joined by a plurality of pins disposed in the ends of the inner cylinder. The inner cylinder is disposed about the door knob, and includes holes in each end to accommodate the door knob stem and to provide key access to the lock.

Disposed within the inner cylindrical member is at least one annular friction ring, impinging both on the knob surface and the bore of the inner member. The frictional engagement between the knob and inner member permits a moderate degree of torque to be transferred therebetween, so that normal operation of the knob is not impaired. Higher amounts of torque cannot be transmitted, so that the torque from a pipe wrench, chain wrench, or the like cannot be applied to the knob. The cylindrical construction of the device is sufficiently strong so that compressive force cannot increase the torque on the knob, nor can the device be broken.

THE DRAWING

FIG. 1 is an exploded view of the various parts of the present invention.

FIG. 2 is a perspective view of the inner cylindrical member of the present invention.

FIG. 3 is a cross-sectional side elevation of the present invention.

FIG. 4 is an end view of the present invention.

DESCRIPTION OF THE PREFERRED EMBODIMENT

The present invention generally comprises an anti-theft door knob protective device which is adapted to be secured to the knob assembly. With reference to the accompanying Figures, the device includes an outer cylindrical member 11 which is open at one end 12 and which includes an inwardly extending flange 13 at the other end 14. A pair of diametrically opposed ribs 16 are disposed parallel to the cylindrical axis, extending inwardly radially from the bore of the member 11. The exterior of the member 11 is provided with a plurality of ridges 17 which aid in manually gripping the member.

An inner cylindrical member 18 is disposed concentrically within the outer member 11, dimensioned to be slidably retained therein. The member 18 includes a pair of axially extending grooves 19 which slidably receive the ribs 16. Thus the member 18 is axially slidable and rotationally fixed with respect to the outer member 11. The member 18 includes an end 21 having a central hole 22 therein, and an end 23 provided with a key access hole 24 centrally disposed therein. Member 18 is bifurcated along an axial plane, each half 26 and 27 being releasably joined together by a pair of locating pins 28 disposed in appropriate holes in the ends 21 and 23.

Within a member 18 are disposed a pair of annular friction rings 29, impinging on the outer surface of the door knob as well as the inner surface of the member 18. It should be noted that the close fit of member 18 within the member 11 will cause the two halves 26 and 27 to remain assembled together.

The invention also includes a retaining ring 31 within the member 11 which includes an annular portion 32 and a radially outwardly extending flange 33. The flange 33 cooperatively engages the flange 13, as shown in FIG. 3, so that the outer member 11 freely rotates thereabout while being retained thereby.

In describing the use and function of the present invention, it must first be understood that a door knob assembly generally includes a knob 34 secured to a rotatable knob stem 36. The stem extends from the latch mechanism in the door through a plate or rose 37 which is fixedly secured to the door. To employ the present invention it is first necessary to remove the knob assembly and rose, as is well known in the art. The friction rings 29 are then secured about the knob, and the two halves 26 and 27 of the member 18 are assembled together about the knob, held together by the pins 28. It may be appreciated that due to varying outside diameters among knobs, a selection of friction rings may be provided to insure proper impingement on the knob and bore of member 18.

The knob stem extends through the hole 22 in the end of member 18, which is axially slidably disposed in member 11 to accommodate knob stems of various lengths. With the ring 31 disposed in the end 14 of member 11, the knob and rose and assembled member 18 is inserted through the open end 12 into member 11, the rose impinging on the retaining ring, as shown in FIG. 3, and the ribs 16 engaging the grooves 19. The knob assembly is then rejoined to the latch mechanism, and the rose is secured to the door, thereby securing the present invention about the knob assembly.

The various parts of the present invention, with the exception of the friction rings, are formed of high impact plastic, such as nylon. The concentric cylinder construction provides great structural strength, preventing the breaking of the device. The outer cylinder may be rotated manually, the torque being transmitted through the ribs and grooves to friction rings and thence to the knob. The frictional engagement of the rings transmits sufficient torque to effect normal actuation of the lock mechanism. The key access hole permits locking and unlocking of the door knob in the normal manner.

Should a thief attempt to break the lock by high torque means such as a pipe wrench, the wrench must be placed about the outer member 11. Any excess torque applied in such manner will merely cause the inner and outer members to spin about the knob, so that the lock mechanism will be protected from such force that it would otherwise be destroyed. Thus this method of burglary is defeated.

It may be appreciated that although the present invention is described as a device adapted to be secured to existing door knob assemblies, it may also be included in the original design of door knob assemblies during the manufacturing process, or during the initial installation process.

We claim:

1. A door knob protective device, comprising a first member secured about a door knob, said first member being formed of rigid, non-compressible material, and friction means disposed within said first member and about said door knob for transmitting a limited and unincreasable amount of torque therebetween, said friction means including a second member, within said first member, secured about said knob, and wherein said first and second members include at least one pair of cooperating torque and groove portions to transmit torque therebetween.

2. The device of claim 1, wherein said tongue and groove portions are parallel to the axis of rotation of said knob, and said second member is freely positioned with respect to said first member in the axial direction.

3. The device of claim 1, wherein said second member comprises a hollow cylindrical member having a hole in each end thereof, said cylindrical member being formed of two longitudinal half cylinders joined along a longitudinal axis.

4. The device of claim 1, wherein said friction means comprises at least one friction member disposed within said second member and about said knob and impinging on said knob and the interior surface of said second member.

5. The device of claim 4, wherein said friction member comprises an annular ring secured about said knob.

6. The device of claim 1, wherein said first member comprises a hollow cylindrical member, and said first and second members are joined in a fixed rotational relationship each to the other, said friction means further including means for providing a limited torque engagement between said second member and said knob.

7. A door knob protective device, comprising a first member secured about a door knob, and friction means disposed between said first member and said door knob for transmitting a limited amount of torque therebetween, said first member comprising a hollow cylindrical member, and further including a retaining ring pivotally joined in said first member and secured to the surface from which said knob extends.

* * * * *